United States Patent [10]

Reinhardt

[11] 4,045,898

[45] Sept. 6, 1977

[54] MAT-RETAINING SPRING FOR PICTURE FRAME

[75] Inventor: James Donald Reinhardt, Pewee Valley, Ky.

[73] Assignee: Cardinal Extrusions Co., Louisville, Ky.

[21] Appl. No.: 720,271

[22] Filed: Sept. 3, 1976

[51] Int. Cl.[2] ..... G09F 1/12

[52] U.S. Cl. ..... 40/156

[58] Field of Search ..... 40/156, 152, 152.1

[56] References Cited

U.S. PATENT DOCUMENTS

| | | | |
|---|---|---|---|
| 648,523 | 5/1900 | Pierce | 40/156 |
| 2,633,653 | 4/1953 | Angus et al. | 40/156 |
| 3,557,478 | 1/1971 | Sitzberger | 40/156 X |

FOREIGN PATENT DOCUMENTS

| | | | |
|---|---|---|---|
| 618,051 | 8/1935 | Germany | 40/156 |

*Primary Examiner*—Russell R. Kinsey
*Assistant Examiner*—Wenceslao J. Contreras
*Attorney, Agent, or Firm*—Arthur F. Robert

[57] ABSTRACT

An aluminum picture frame conventionally comprises: four perimetric frame sections of U-shape in cross-section, each section having a perimetric wall, a ribbed front face flange and a ribbed rear face flange which should be narrower than the front face flange, each ribbed face flange being mitered at its opposite ends, the adjacent mitered ends of these sections being rigidly joined to form an integrated open-ended frame. At least one mat-retaining spring is used in each of two or more opposed frame sections to retain a mat extending across the inner side of the front face opening of the frame. The preferred form of each retainer comprises: a spring wire open-looped or corrugated at intervals along its length to form a narrow strip of suitable length, which is bent to a concavo-convex shape to provide it with a resilient concavo-convex undulation. When this strip is slightly flattened, inserted into the space between the ribbed surfaces of the front and rear face flanges and released, it is operative to press forwardly and rearwardly against those ribbed surfaces with a resilient force sufficient to press an interposed mat firmly against the ribbed front face flange. A concavo-convex retainer with closed loops may also be used. Corresponding loops of corresponding retainers, at opposite sides of the frame, also provide suitable anchorages for the ends of a frame-hanging wire and a sturdy support for the hanging load.

10 Claims, 9 Drawing Figures

MAT-RETAINING SPRING FOR PICTURE FRAME

CROSS REFERENCES TO RELATED APPLICATIONS

A related application has not been filed.

BACKGROUND OF THE INVENTION

1. Field Of The Invention

This invention relates to a spring retainer for engaging and holding a mat more or less stationary against the inner side of the ribbed front face flange of a rectangular picture frame, which is usually composed of a metal such as aluminum.

2. Description Of The Prior Art

The Spertus U.S. patent No. 2,651,129 shows an integrated rectangular picture frame, conventionally having a perimetric wall, a ribbed front face flange and a ribbed rear face flange with a mat pressed against the inner side of the front face flange. Both flanges and the interposed perimetric wall of each frame member cooperate to form on each face flange, a U-shaped channel which opens inwardly. A pair of rod-like L-shaped members is provided, one for each of two opposed frame channels. The vertical leg of each ell is placed in its channel and arranged for rotation from one position, wherein said leg and its foot are located wholly within the confines of the frame, to another position, wherein said foot projects outwardly from the frame to support it in an upright position on a horizontal surface. Each leg is retained in its place within its channel and pressed against the mat by a spring retainer interposed between it and the inner side of the rear face flange. This spring comprises an arcuate strip of spring sheet metal having its ends forked to straddle the leg of the L-shaped member and its center dented rearwardly to project into a complementary opening in the rear face flange.

The Tuchinsky et al U.S. Pat. No. 3,613,280 shows a similarly flanged rectangular frame with several spaced spring retainers, each comprising a planar rectangular base arranged in face-to-face contact with the inner face of the perimetric wall and provided with a spring-like flap which extends inwardly and forwardly to press resiliently against a surface interposed between it and the front face flange.

The Chambers U.S. Pat. No. 3,901,496 also shows a similarly flanged rectangular picture frame with a pair of "Spertus type" spring retainers, each comprising a strip of spring sheet metal bent to an arcuate shape with its ends forked and its center barbed. In Chambers, the forked ends straddle a rib of the rear face flange while its barbed center digs into the mat which the spring presses against the ribbed front face flange.

SUMMARY OF THE INVENTION

Objects Of The Invention

The principal object of the present invention is to provide a simple resilient mat-retainer which may be inexpensively constructed and easily inserted into place and which, when inserted, effectively presses the mat against the inner surface of the front face flange and provides a sturdy anchorage for the framehanging wire and a sturdy support for the hanging load of the frame.

Another important object is to provide a retainer which is not readily subject to accidental removal from the frame and which can be readily removed when desired.

Statement Of The Invention

The preferred embodiment of the invention comprises a suitable length of spring wire which is corrugated in one direction and bent or bulged at 90° to said one direction to provide a concavo-convex strip of suitable length with at least one permanent resilient undulation having an amplitude sufficient to bridge the space between and press against the ribbed front and rear face flanges of the picture frame in which it is to be used. A suitable spring preferably has three spaced corrugations, including a centrally disposed corrugation and two end corrugations, and a single undulation having an amplitude such that, when the retainer is sufficiently compressed or flattened, it can be inserted into the space between the ribbed face flanges of the frame, and, when inserted and released, it expands until it is partially compressed between the ribbed front and rear face flanges of the frame, wherein it is operative to press an interposed mat against the ribbed face flange of the frame and thereby hold the mat in place at that point.

My looped concavo-convex retainer, when operatively inserted, provides one portion which extends forwardly through the major plane of the mat to prevent the mat from shifting laterally where such shift is not prevented by ribs on the frame. It also provides front and rear portions which extend past front and rear edges of their respective adjacent front and rear face flange ribs so that said ribs prevent the accidental lateral movement which may result in the removal of the retainer from the frame. My retainer also provides pointed ends which engage the inner face of the adjacent face flange and, through such engagement, prevent the retainer from sliding lengthwise along its frame section as it might otherwise do under a sufficiently heavy hanging load. Again, each loop, whether open or closed, provides a sturdy anchorage for one end of the wire conventionally used to hang the frame.

BRIEF DESCRIPTION OF THE DRAWINGS

One embodiment of the invention is illustrated in the accompanying drawings wherein.

DESCRIPTION OF THE PREFERRED EMBODIMENT

My preferred form of retainer is fashioned out of a suitable length of spring wire 1 which is formed with at least three corrugations, including a center corrugation 2 and a pair of end corrugations 3 and 4. Each of the opposite ends 5 and 6 of the wire, which is pointed for frame-engagement purposes, terminates a short distance beyond the end of its corrugation.

Figure 2:
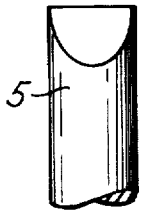
FIG. 2 is an enlarged elevational view of the upper end portion of the retainer shown in FIG. 1.
Figure 3:
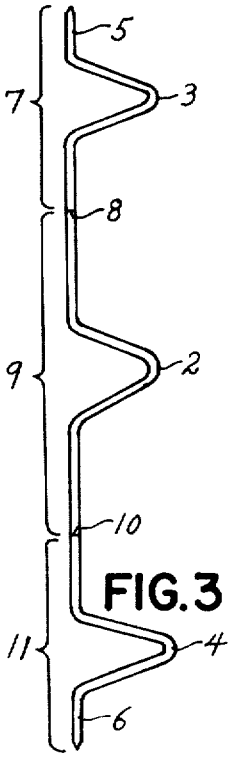
FIG. 3 is an elevational view of the concave side of the spring retainer shown in FIG. 1.
Figure 4:
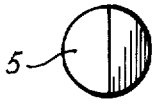
FIGS. 4 and 5 are elevational views of one end and of one end portion of the retainer of FIG. 3.
Figure 5:
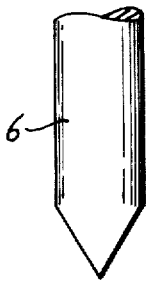

The wire may curve in any suitable manner along its length to an arcuate or concavo-convex shape sufficient to bridge the space between rear and front face flanges of a picture frame. Preferably the wire is shaped to lie in three straight flat planar sections designated 7, 9 and 11, each of which extends at an angle approximating 35° to the adjacent section, as seen in FIG. 2. Thus, adjoining planar sections 7 and 9 are bent at their juncture 8 while adjoining sections 9 and 11 are bent at their juncture 10.

Figure 6:
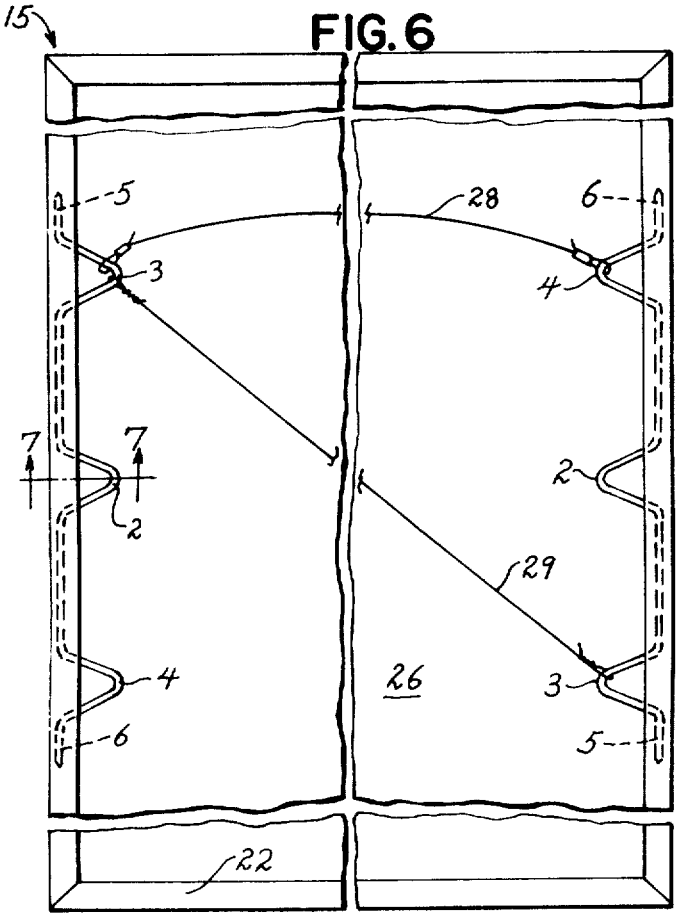
FIG. 6 is an elevational view of the rear face of a rectangular picture frame equipped with a pair of my concavo-convex spring retainers and with a wire hanger extending from one retainer to the other.
Figure 7:
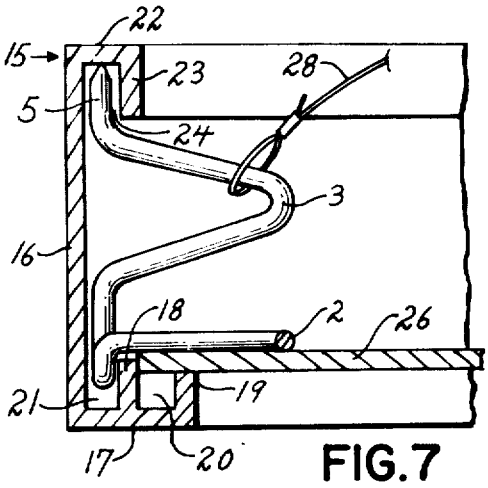
FIG. 7 is an enlarged section taken on line 7—7 of FIG. 6.
Figure 8:
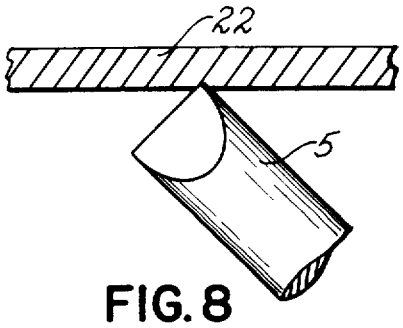
FIG. 8 is an enlarged fragmentary view showing a pointed end of my retainer in engagement with the inner surface of a face flange.

FIGS. 6–8 show the retainer associated with a picture frame 15 conventionally composed of extruded aluminum and conventionally fashioned in rectangular shape. The conventional frame 15 is extruded and then mitered at suitable lengths into suitable sections, which are assembled in rectangular form. Each section has a perimetric wall 16, a front flange means composed of a wide face flange 17 characterized by a pair of short inwardly extending ribs 18 and 19 and a pair of inwardly open channels 20 and 21, and rear flange means composed of a rear face flange 22 characterized by a short inwardly extending rib 23 and an inwardly open narrow channel 24.

Figure 1:
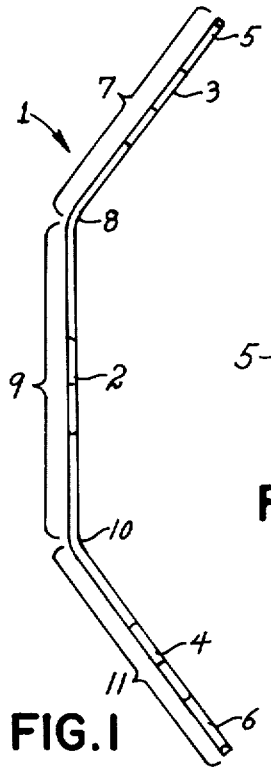
FIG. 1 is an elevational view of one edge of a concavo-convex spring retainer embodying my invention.

In the course of mounting two or more retainers on a frame, a mat 26 is placed within the frame 15 and dimensioned to rest upon the front flange means, more particularly, the marginal rib 19. The word "mat" is used herein to designate a frame-mountable display, such as a picture, with or without either a cardboard or other backing on its rear face or a transparent sheet of glass or plastic on its front face. One spring retainer has its center corrugation 2 pressed against the mat 26 at a suitable point on the mat along one side of the frame whereupon the retainer is flattened toward the mat and slipped laterally into the channel space of the adjacent side or section of the picture frame and then allowed to spring back toward its FIG. 1 shape until its pointed ends 5 and 6 press firmly against the rear flange means, more particularly, the inside face of the rear face flange 22. A cooperating retainer is similarly mounted in the opposite side or section of the picture frame. With both retainers in place in a small or "lightweight" frame, a picture hanging wire 28 may be secured to upper end corrugation 3 of the retainer on one side of the frame and upper end corrugation 4 of the retainer on the opposite side thereof. Where a large "heavyweight" frame may provide a load large enough to subject the upper end of a retainer to the possibility of being pulled out of the frame, the hanging wire 28 should be secured to the lower end corrugations, which renders the load operative to pull the retainers into tighter engagement with the rear face flanges. Also, if the load is heavy enough to bow the sides of the frame outwardly, the retainers may be connected to each other by a brace wire 29.

Each retainer is reversibly mountable on the frame. Thus, it may be mounted on the frame with its ends pressing firmly against the front flange means (or against a mat thereon) and with its center pressing firmly against the rear flange means. In this case, the hanging wire may, if desired, extend either between the opposed center corrugations or between one pair of opposed end corrugations.

Regardless of how the retainers are inserted within a frame, it will be appreciated that I have provided, in combination: a frame having a perimetric wall with spaced front and rear flange means on said perimetric wall; and a mat retainer composed of a suitable length of wire, which is corrugated in one direction along its length to form a strip of desired width and length, which is bulged in another direction along its length to provide the strip with one resilient concavo-convex undulation having an amplitude sufficient to bridge the frame space between the front and rear flange means, this retainer being laterally insertable at least partially into the frame space, when the retainer is compressed, and tending to expand within said frame space so as to engage the front and rear flanges with sufficient force to hold the retainer on the frame and to retain a mat interposed in the frame between the retainer and the front flange means.

When the center of the retainer engages the front flange means, the pointed end portions or terminals of the retainer preferably extend into the channel space 24 of the rear flange means and "dig" into the metal to prevent vertical slippage of the retainer along the frame. When the retainer is reversed and inserted, its pointed terminals preferably extend into the channel space 21 of the front flange means and prevent slippage as before.

While my preferred form of retainer is provided with three open loops or corrugations designated 2, 3 and 4, more corrugations may be employed but normally they will not be necessary. In fact, my concavo-convex retainer may be restricted to one center corrugation, or one end corrugation, or one of each or two end corrugations. With one of each, one will engage the mat while the other will engage the rear face flange means and also provide a fingerpiece by which it may be held and manipulated during the retainer insertion and removal operations. While sine wave corrugations are shown, square wave loops or other shapes of loops may be employed. Before passing, it may be noted that the rib 19 on the front face flange is desirable but not essential.

Figure 9:
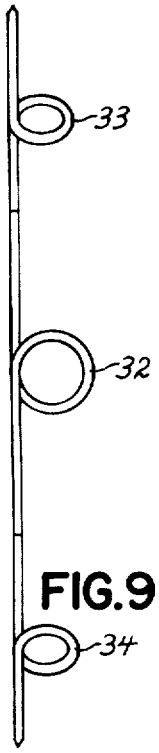
FIG. 9 is an elevational view of the concave side of another embodiment of my concavo-convex retainer.

FIG. 9 shows a modified concavo-convex spring wire retainer, which is the same as (and substantially the full equivalent of) the one shown and described in FIGS. 1–8 except for its use of closed center loop 32 and closed end loops 33 and 34 in place of the open loops 2, 3 and 4. One or two closed loops may be employed but three are preferred.

It will be noted that my resilient strip has a length which is smaller than the smallest of the side and end length dimensions of the frame 15. It has a still smaller width and shallower depth and its concavo-convex curvature, which extends substantially throughout its length and depth, is in a plane normal to its width. Also the basic loops or corrugations point in the same lateral direction across the width of the strip and are confined between its concave and convex faces. When the bulge of the strip is compressed, it becomes laterally insertable sidewise, i.e. edgewise, into an operative position between the face-flange means. Furthermore, it is easy to insert or remove.

Having described my invention, I claim:

1. A mat retainer for the inwardly open frame space of a unitary rectangular frame having a perimetric wall and spaced relatively wide and narrow front and rear face-flange means on said perimetric wall, comprising:

A. a resilient strip having a length smaller than the smallest of the side and end length dimensions of the frame, a still smaller width and shallower depth and also having a concavo-convex curvature substantially throughout its length and depth, said curvature being in a plane normal to its width, 1. said strip being composed of a strand of spring wire provided with at least two loops which are
   a. spaced longitudinally along the length of the strip and
   b. arranged to extend in the same lateral direction across the width of the strip between its concave and convex faces,
2. the bulge of said concavo-convex strip having an amplitude sufficient substantially to bridge the frame space between the front and rear face-flange means,
3. said concavo-convex strip, when its bulge is compressed, being laterally insertable side-wise or edge-wise into an operative position between said face-flange means,
   a. said compressed bulge tending to expand in said operative position toward said front and rear face-flange means, which prevent complete expansion,
4. said concavo-convex strip being operative, when operatively inserted between said face-flange means with a mat in place adjacent the front face-flange means, to exert sufficient expansive force to press the margin of the mat forwardly and hold it against the said front face-flange means.

2. The mat retainer of claim 1 wherein:

A. at least three loops are provided, one at the center of the retainer and one adjacent each end thereof.

3. The mat retainer of claim 1 wherein:

A. at least one loop is closed.

4. The mat retainer of claim 1 wherein:

A. at least one loop is open.

5. The mat retainer of claim 1 wherein:

A. the wire is corrugated along its length to form said loops.

6. The mat retainer of claim 1 wherein:

A. said retainer is reversibly insertable into said frame space.

7. The mat retainer of claim 1 wherein:

A. the opposite ends of said retainer are pointed in a manner rendering them operative, when inserted into said frame space, to extend toward one of said face flange means and operatively dig into a surface within the frame sufficiently to resist endwise sliding of the retainer relative to the frame.

8. The mat retainer of claim 1 wherein:

A. at least three uniformly sized loops in the form of corrugations are provided, one at the center of the retainer and one adjacent each end thereof, all three corrugations pointing laterally in the same direction.

9. In combination:

A. a unitary rectangular frame having a perimetric wall and spaced relatively wide and narrow front and rear face-flange means,
   1. the narrower rear face-flange means forming a large rear drop-in opening through which a mat may be forwardly inserted into the frame space, and
   2. the wider front face-flange means providing a support against which the margins of an inserted mat may be forwardly pressed; and B. a resilient strip having a length smaller than the smallest of the side and end length dimensions of the frame, a still smaller width and shallower depth and also having a concavo-convex curvature substantially throughout its length and depth, said curvature being in a plane normal to the width of said strip,
   1. said concavo-convex strip being composed of a strand of spring wire provided with at least three loops, one adjacent the center and one adjacent each end, said loops being
      a. spaced longitudinally along the length of the strip, and
      b. arranged to extend in the same lateral direction across the width of the strip between its concave and convex faces,
   2. the bulge of said concavo-convex strip having an amplitude sufficient substantially to bridge the space between the front and rear face-flange means of the frame,
   3. said concavo-convex strip, when its bulge is compressed, being laterally insertable side-wise or edge-wise into an operative position between said face-flange means,
      a. said compressed bulge tending to expand in said operative position toward said front and rear face-flange means, which prevent complete expansion,
   4. said concavo-convex strip, when operatively inserted between said face-flange means with a mat in place adjacent the front face-flange means, being operative to exert sufficient expansive force to press the margin of the mat forwardly and hold it against the said front face-flange means.

10. The combination of claim 9 wherein:

A. said retainer is reversibly insertable into said frame space.

* * * * *